US005183016A

United States Patent [19]

Budde

[11] Patent Number: 5,183,016

[45] Date of Patent: Feb. 2, 1993

[54] HYDRAULIC VALVE CLEARANCE COMPENSATOR

[75] Inventor: Volker Budde, Kandelgasse, Fed. Rep. of Germany

[73] Assignee: Firma Carl Freudenberg, Weinheim/Bergstrasse, Fed. Rep. of Germany

[21] Appl. No.: 861,745

[22] Filed: Apr. 1, 1992

[30] Foreign Application Priority Data

Jul. 24, 1991 [DE] Fed. Rep. of Germany ..... 4124484

[51] Int. Cl.[5] ..... F01L 1/24; F01L 1/14

[52] U.S. Cl. ..... 123/90.55; 123/90.49

[58] Field of Search ..... 123/90.35, 90.48, 90.49, 123/90.52, 90.55

[56] References Cited

U.S. PATENT DOCUMENTS

| | | | |
|---|---|---|---|
| 2,595,583 | 5/1952 | Johnson | 123/90.49 |
| 4,279,226 | 7/1981 | Lampredi et al. | 123/90.55 |
| 4,392,462 | 7/1983 | Lesher | 123/90.55 |
| 4,463,713 | 8/1984 | Barale | 123/90.55 |
| 4,662,324 | 5/1987 | Titolo | 123/90.55 |

*Primary Examiner*—E. Rollins Cross
*Assistant Examiner*—Weilun Lo
*Attorney, Agent, or Firm*—Sprung Horn Kramer & Wood

[57] ABSTRACT

A hydraulic valve clearance compensator for an internal combustion engine. The compensator has a housing shaped essentially like an upside-down cup with a flat base. The housing slides up and down inside a central bore. The housing accommodates two concentric hollow cylinders sealed off from each other and separated by an axially resilient compression spring. In the wall of the housing there is at least one inlet that supplies lubricant to one cylinder. Between the inlet and the cylinders is a check valve that allows lubricant to flow through the inlet into the cylinder and prevents it from flowing out. At least the section of the housing between the inlet and the base is narrower than the rest of the housing.

12 Claims, 3 Drawing Sheets

HYDRAULIC VALVE CLEARANCE COMPENSATOR

BACKGROUND OF THE INVENTION

The present invention concerns a hydraulic valve clearance compensator for an internal combustion engine. The compensator has a housing shaped essentially like an upside-down cup with a flat base. The housing slides up and down inside a central bore. The housing accommodates two concentric hollow cylinders sealed off from each other and separated by an axially resilient compression spring. In the wall of the housing there is at least one inlet that supplies lubricant to one cylinder. Between the inlet and the cylinders is a check valve that allows lubricant to flow through the inlet into the cylinder and prevents it from flowing out.

A valve clearance compensation device of this type is known from the German Patent Publication No. OS 3,150,083. A flexible rubber seal constitutes a check valve that seals off a reservoir of hydraulic fluid. The valve tappet is supplied with enough fluid to ensure normal operation even when the engine has been inoperative for some time because the valve prevents fluid from leaking out of the reservoir. The tappet is supplied through a bore with lubricant from the engine's lubricating system. The bores in the cylinder head make a mechanism of this type very expensive to manufacture.

SUMMARY OF THE INVENTION

The principal object of the present invention is to provide an improved hydraulic valve clearance compensation device of the aforesaid type, whereby the cylinder is always supplied with fluid even when the engine is switched off for some time with the valve held open, and whereby there are no special oil bores in the cylinder head to supply the compensator.

This object, as well as other objects which will become apparent from the discussion that follows, were achieved in a valve clearance compensation device in accordance with the invention, by making the housing narrower at the base than at the level of the inlet. Oil is supplied during the housing's upward stroke by way of a gap left between the cylindrical bore and the shorter-diameter section of the housing. The oil travels from the inlet, through the first check valve, into the first cylinder, through another check valve, and into the second cylinder. The second cylinder is pressurized. The oil is the same oil injected into the cylinder head to lubricate the camshaft, cam, and tappet.

Upon termination of the upward stroke the engine valve is closed, and the compression spring maintains the two cylinders farthest apart axially. The valve opens when a cam forces the compensator down. The second check valve, which separates the second cylinder from the first, is closed, as is the first check valve, which prevents a backward flow out of the first cylinder and into the cylinder head through the inlet. The camshaft is accordingly axially secured to the valve almost rigidly. Also, at least the first cylinder is completely full of oil no matter what state the engine is in, and no matter how long the engine is in the given state. Clatter deriving from air traveling from the first and into the second cylinder is completely eliminated. The main advantage is that the difficult-to-produce bores that used to be needed in the cylinder head to supply lubricant to the compensator are no longer necessary. The embodiment in accordance with the invention is accordingly of particular advantage from the aspect of economy.

The outside of the housing can taper. Such a housing is particularly simple and hence inexpensive to manufacture.

The outside of the housing can have at least one chamfer extending into the base. The advantage is that the housing can fit all the way into the bore, eliminating the wear that results from the housing tilting as it travels up and down. One preferred embodiment of the housing has four such chamfers, or facets, evenly distributed around it. The housing can taper continuously or discontinuously. The housing can accordingly be shaped for any application. The size and shape of the gap between the housing and the bore are dictated by the sizes and shapes of the first check valve, the lubricant inlet, and the bore.

The housing in one embodiment has a partition with an annular channel between it and the base that supplies fluid to the first cylinder. The first check valve can be resilient, for example, and radially secured in the vicinity o the lubricant inlet by the partition. The partition also ensures smooth operation in a small compensator.

The face of the first cylinder facing the channel rests against the surface of the partition that axially faces the base of the housing, whereas the second cylinder rests against it only when the spring is compressed as much as possible. The pressure in the first cylinder can be maintained below a certain threshold if the face of the first cylinder and/or the surface of the partition that faces it have a rough depth of at least 1 μm. When the pressure in the first cylinder becomes too high, the fluid inside it can leak out between the cylinder and the partition. Leakage can also occur while the valve clearance compensator in accordance with the invention is in operation between the outside of the first cylinder and the inside of the second cylinder. Since the first cylinder travels up and down inside the second, which is pressurized, lubricant penetrates into the gap between their walls. Just a small amount of lubricant lubricates the two parts and reduces friction. Furthermore, the lubricant is continuously replaced.

The second cylinder can be kept from falling out of the housing, while still being free to travel up and down inside it as intended, by a retainer. The second cylinder retainer ensures simple installation of a clearance compensator in a valve mechanism. The retainer can for example fit in a groove in the inner surface of the housing. It can, in addition to axially securing the second cylinder, radially secure the partition and the first check valve accommodated therein.

To facilitate inserting and removing the retainer and to allow leaking lubricant to drain out of the cylinders, the retainer can have at least one recess facing the engine's combustion chamber.

In another advantageous embodiment of the invention is the partition and retainer combined into a single component which is preferably made of a plastic polymer. There are two advantages of this structure. The assembly is easier to install and the compensator has less mass to be accelerated. The compensator will function more effectively, and with less wear, if the retainer is made of a material with a particularly low coefficient of friction or is coated with a material that will reduce the friction between the moving parts.

A valve clearance compensator in accordance with the invention can be employed in the cylinder head of an internal combustion engine without separate lines to supply it with lubricant.

The preferred embodiments of the present invention will now be described with reference to the accompanying drawings, which are partly schematic illustrations of the significant components.

DESCRIPTION OF THE PREFERRED EMBODIMENTS

Figure 1:
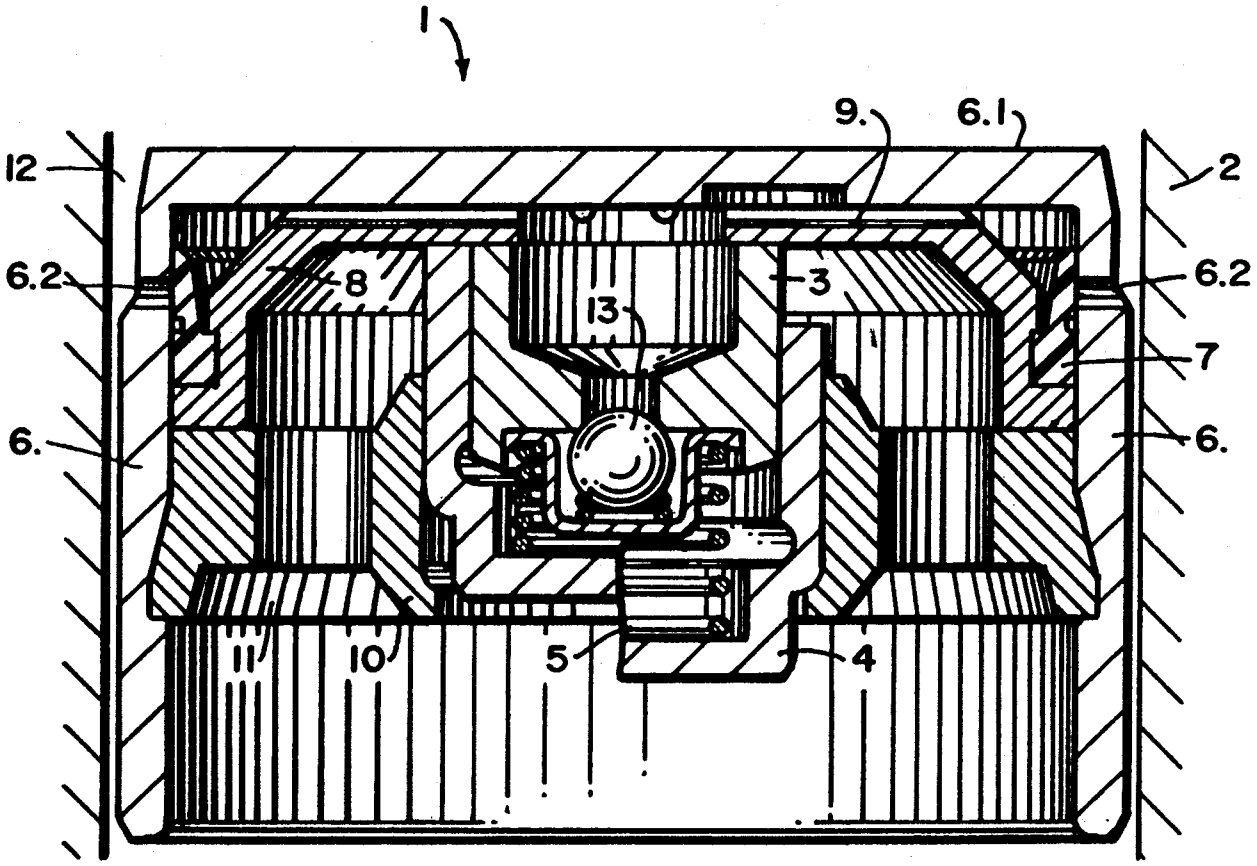
FIG. 1 is an axial cross sectional view of a hydraulic valve clearance compensator according to the invention, with a partition separate from a retainer.

FIG. 1 represents a hydraulic valve clearance compensator 1 at two different stages of operation. The left-hand side of the figure illustrates the pressurized second cylinder 4 at minimum capacity. Its open end rests against a partition 8. The right-hand side of the figure illustrates second cylinder 4 at its maximum capacity, with an axial projection resting against a supporting surface on a retainer 10. The stage illustrated on the left occurs, for example, when the engine is switched off and the compensator 1 has for some time been axially compressed between a cam (not shown) and an open valve (also not shown). The oil in the pressurized second cylinder 4 will gradually leak out by way of the narrow gap between that cylinder and first cylinder 3 and will simultaneously slowly close the adjacent valve. The displacement of second cylinder 4 in relation to the stationary first cylinder 3 and housing 6 will terminate when, for example, it rests as illustrated against partition 8.

The right-hand side of the figure illustrates the compensator 1 in a state that occurs while the engine is in operation. With no outside load—i.e., when the compensator is at the top of its stroke—a compression spring 5 forces the cylinders apart. At this stage, with second cylinder 4 unpressurized, any lubricant in the first cylinder 3 or in a communicating channel 9 will flow back into the second cylinder through the second check valve 13 and replenish any fluid lost from leakage. The compensator 1 is supplied through a gap 12 between the housing 6 and a central bore 2. The section of housing 6 between inlet 6.2 and base 6.1 is narrower than the rest of the housing.

The operation of the compensator will now be described. The initial stage is the stage at which the internal combustion engine's valve is completely open, meaning that the cam has moved the compensator 1 to its lowermost position. Above the housing 6 and along the inner surface of the bore 2 is the oil injected to lubricate the camshaft, the cam, and the surface of the housing that the cam rolls over. As the housing travels upward, the oil is forced into the gap 12 of wedge-shaped cross-section, through a lubricant inlet 6.2, through a first check valve 7, into the channel 9, and finally into this first cylinder 3. The upward stroke of the compensator 1 terminates at the upper point of return. The valve is now closed. The cam then lowers the compensator I again, opening the valve. First the check valve 7 will prevent the oil from flowing back out of the first cylinder 3 and the channel 9, through inlet 6.2, and into the gap 12. In the stage illustrated on the right-hand side of the figure, leakage from the pressurized second cylinder 4 is replaced with fluid flowing back out of the first cylinder 3 and the channel 9, resulting in an extensively rigid connection between the cam and the valve. Even when the engine is off, the first check valve 7 will prevent the first cylinder 3 and the channel 9 from operating empty as time goes on. There will accordingly always be enough oil in first cylinder 3 to supply the interior of pressurized second cylinder 4.

There is accordingly no risk of air entering the pressurized cylinder when the engine is operating.

Figure 2:
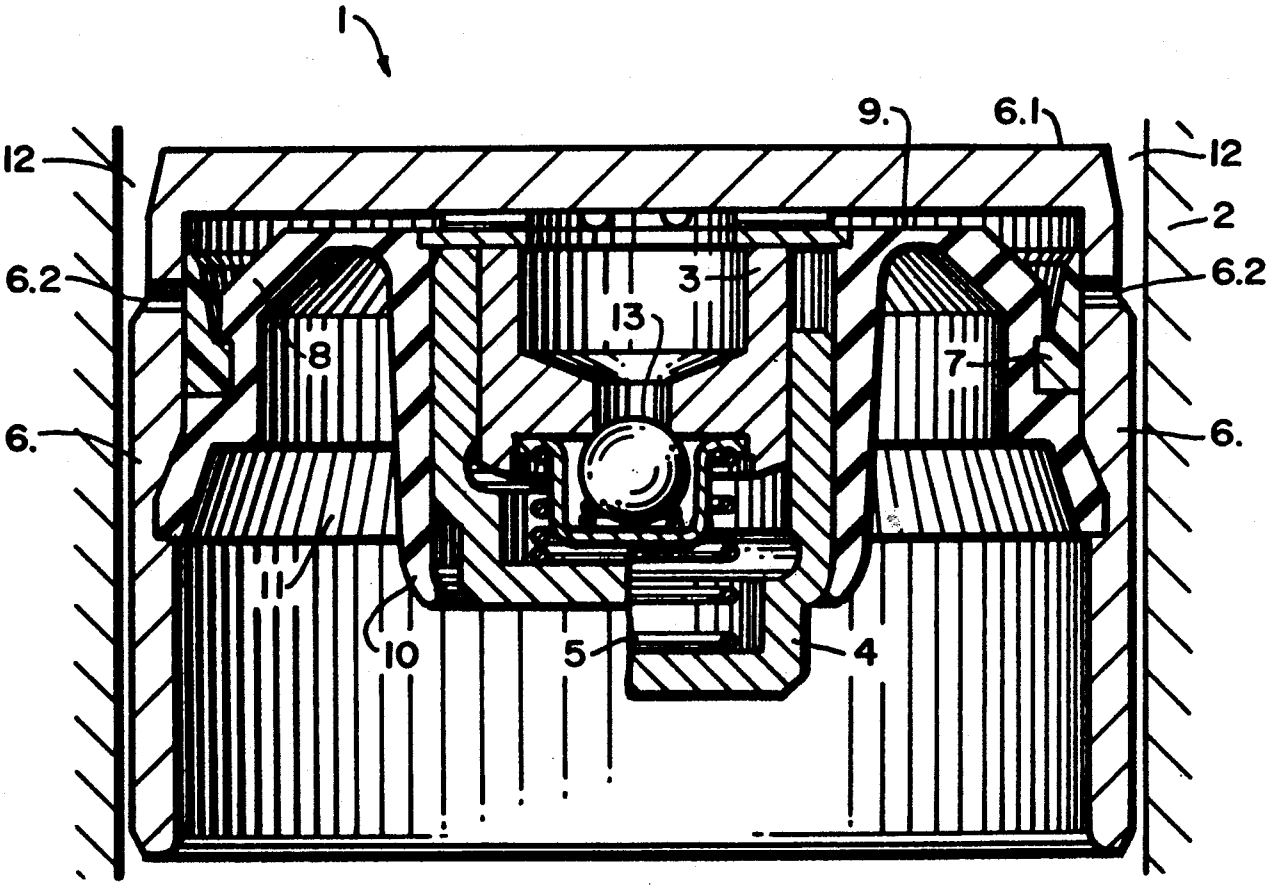
FIG. 2 is an axial cross sectional view of a hydraulic valve clearance compensator according to the invention, with a combination partition and retainer.

FIG. 2 illustrates a hydraulic valve clearance compensator very similar to the one illustrated in FIG. 1. The primary difference is that the partition 8 and the retainer 10 are the same component and made out of a polymeric plastic material. They function as hereintofore described.

Figure 3:
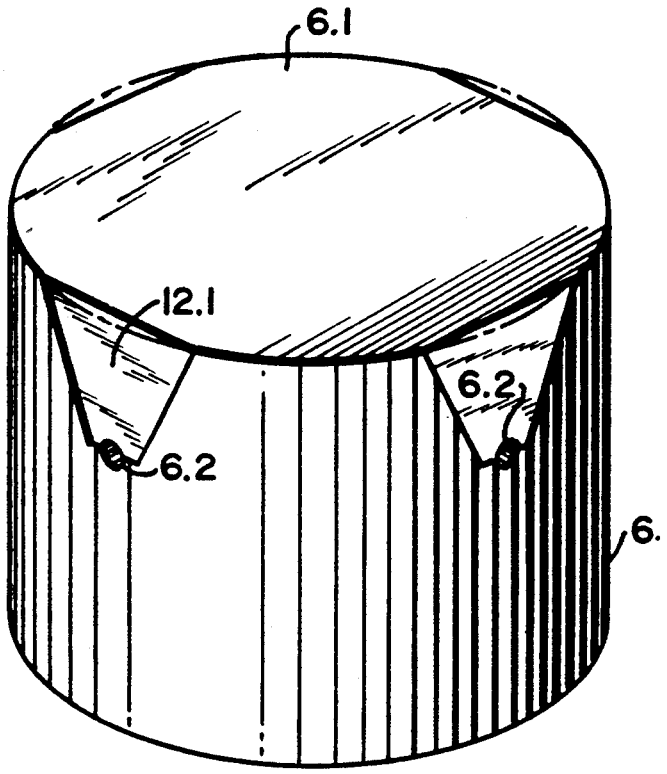
FIG. 3 is a perspective view of a compensator housing with chamfers according to the present invention.

FIG. 3 is a perspective view of a valve clearance compensator wherein the housing 6 narrows discontinuously in the vicinity of its base 6.1. Chamfers 12.1 are shallow enough in the vicinity of their demarcations to leave the outside diameter of the housing uniformly constant between them axially. In addition to good operating properties, this embodiment, due to the length of the housing, definitely decreases the risk of its tilting as it moves up and down inside the central bore (not shown).

The major advantage of the invention is that oil is supplied automatically during the compensator's upward stroke because of the pressure that occurs in the gap 12. The result is considerable simplification in the design and manufacture of cylinder heads and blocks for internal combustion engines.

There has thus been shown and described a novel hydraulic valve clearance compensator that fulfills all the objects and advantages sought therefor. Many changes, modifications, variations, and other uses and applications of the subject invention will, however, become apparent to those skilled in the art after considering this specification and the accompanying drawings, which disclose the preferred embodiments thereof. All such changes, modifications, variations, and other uses and applications that do not depart from the spirit and scope of the invention are deemed to be covered by the invention, which is to be limited only by the claims that follow.

What is claimed is:

1. In a hydraulic valve clearance compensator for an internal combustion engine, with a housing shaped essentially like an upside down cup with a flat base, sliding up and down inside a central bore, accommodating two concentric hollow cylinders sealed off from each other and separated by an axially resilient compression spring, and with at least one inlet in its wall that supplies lubricant to one cylinder, and with a check valve arranged between the inlet and the cylinders that allows lubricant to flow through the inlet into the cylinders but prevents it from flowing out, the improvement wherein at least the section of the housing between the inlet and the base is narrower than the rest of the housing.

2. The valve clearance compensator defined in claim 1, wherein the outside of the housing tapers toward the base.

3. The valve clearance compensator defined in claim 1, wherein the outside of the housing has at least one chamfer extending into the base.

4. The valve clearance compensator defined in claim 1, wherein the housing taper continuously.

5. The valve clearance compensator defined in claim 1, wherein the housing tapers discontinuously.

6. The valve clearance compensator defined in claim 1, wherein the housing has a partition with an annular channel between it and the base that supplies fluid to the first cylinder.

7. The valve clearance compensator defined in claim 1, wherein the face of the first cylinder facing the channel rests against the surface of the partition that axially faces the base of the housing, and wherein the second cylinder rests against the surface of the partition only when the spring is substantially compressed.

8. The valve clearance compensator defined in claim 1, wherein the face of the first cylinder and the surface of depth of at least 1 μm.

9. The valve clearance compensator defined in claim 1, wherein the second cylinder is kept from falling out of the housing, while still being free to travel up and down inside the housing, by a retainer.

10. The valve clearance compensator defined in claim 9, wherein the retainer has at least one recess facing the engine's combustion chamber.

11. The valve clearance compensator defined in claim 9, wherein the partition and retainer are combined into a single component.

12. The valve clearance compensator defined in claim 1 employed in the cylinder head of a internal combustion engine without separate lines to supply lubricant.

* * * * *